US006619927B1

(12) United States Patent
Becker et al.

(10) Patent No.: US 6,619,927 B1
(45) Date of Patent: Sep. 16, 2003

(54) EJECTOR PUMP

(75) Inventors: Dirk Becker, Bebra (DE); Johannes Dichmann, Rostenburg (DE); Peter Marx, Wolfsburg (DE)

(73) Assignee: Siemens AG, Munich (DE)

( * ) Notice: Subject to any disclaimer, the term of this patent is extended or adjusted under 35 U.S.C. 154(b) by 31 days.

(21) Appl. No.: 09/890,034

(22) PCT Filed: Nov. 22, 2000

(86) PCT No.: PCT/EP00/11607

§ 371 (c)(1),
(2), (4) Date: Dec. 13, 2001

(87) PCT Pub. No.: WO01/38719

PCT Pub. Date: May 31, 2001

(30) Foreign Application Priority Data

Nov. 26, 1999 (DE) ..... 199 57 066

(51) Int. Cl.[7] ..... F04B 23/04
(52) U.S. Cl. ..... 417/76; 417/158; 123/514
(58) Field of Search ..... 417/76, 151, 158, 417/198; 123/514

(56) References Cited

U.S. PATENT DOCUMENTS 4,834,132 A * 5/1989 Sasaki et al. ..... 137/143
4,886,031 A * 12/1989 Scheurenbrand et al. ... 417/151
5,016,670 A * 5/1991 Sasaki et al. ..... 137/574
6,394,760 B1 * 5/2002 Tell ..... 417/174
6,478,014 B1 * 11/2002 Kohlhaas ..... 123/509

FOREIGN PATENT DOCUMENTS

GB 2 271 327 A * 4/1994

* cited by examiner

*Primary Examiner*—Charles G. Freay
*Assistant Examiner*—Michael K. Gray
(74) *Attorney, Agent, or Firm*—Cohen, Pontani, Lieberman & Pavane

(57) ABSTRACT

An ejector pump for a delivery unit provided in a fuel tank of a motor vehicle has a nozzle produced integrally with a mixing tube. The mixing tube is shaped in the form of a tubular cylinder, so that virtually the entire ejector pump may be produced from plastic in a mold allowing axial demolding. The nozzle is therefore aligned,exactly with respect to the mixing tube. The ejector pump consequently has a particularly high efficiency.

9 Claims, 1 Drawing Sheet

EJECTOR PUMP

CROSS REFERENCE TO RELATED APPLICATIONS

The present invention is a national phase application of PCT/EP00/11607, filed on Nov. 22, 2000. Priority is claimed on that application and on the following application, 199 57 006.3, filed in Germany on Nov. 26, 1999.

BACKGROUND OF THE INVENTION

1. Field of the Invention

The invention relates to an ejector pump with a nozzle arranged upstream of a mixing tube and with holding elements for aligning the nozzle with respect to the mixing tube, the nozzle and the mixing tube being produced from plastic by the injection-molding process.

2. Description Of The Prior Art

Ejector pumps of the above type are often used in fuel tanks of modern motor vehicles and are therefore known. The ejector pumps are usually used for filling a surge chamber arranged in the fuel tank or, in the case of a multi-chamber tank, for delivering fuel from one chamber to the other chamber. In the production of the known ejector pump from fuel-resistant plastic, the mixing tube and the nozzle are produced in separate molds, for example by the injection-molding process, and are subsequently adhesively bonded to each other. The holding elements are in this case shaped as webs fastened integrally to the nozzle and, after fitting of the ejector pump, are supported on corresponding surfaces of the mixing tube.

A disadvantage of the known ejector pump is that the nozzle and the mixing tube each have tolerances and therefore can only be aligned with each other with great difficulty. However, misalignment of the nozzle with respect to the mixing tube leads to a great reduction in the efficiency of the ejector pump.

SUMMARY OF THE INVENTION

The invention is based on the problem of designing an ejector pump of the type stated at the beginning in such a way that it has particularly high efficiency and can be produced at low cost.

This problem is solved according to the invention by the nozzle and the mixing tube being shaped in a common mold for production as an interconnected component.

This shaping has the effect that the nozzle and the mixing tube are aligned exactly in relation to each other after they are removed from the mold. As a result, the ejector pump has particularly high efficiency. Since all the main components of the ejector pump according to the invention are produced integrally, there is likewise no reduction in its efficiency as a result of defective assembly. By being produced in a single mold, the ejector pump can also be produced at particularly low cost. A further advantage of this shaping is that the ejector pump according to the invention has high stability and therefore holding forces in the fuel tank do not lead to a reduction in its efficiency.

A simultaneous alignment and fastening of the ejector pump according to the invention, intended for the delivery of fuel into a surge chamber of a motor vehicle, can be achieved in a simple way if it has means for bracing it in a delivery unit or a surge chamber arranged in a fuel tank of a motor vehicle. This has the effect of greatly simplifying the fitting of the ejector pump in the delivery unit. A further advantage of this ejector pump braced in the delivery unit is that the delivery unit is of a very compact construction and can be put together in a modular manner to form a preassemblable unit.

The connection of the ejector pump according to the invention to a fuel line is particularly simple in design terms if the nozzle has on its side facing away from the mixing tube a sealing flange and means for bracing it with a correspondingly shaped fuel line. For the bracing, the sealing flange of the nozzle and the fuel line may for example be screwed to each other or connected to each other by snap-in means.

It helps to simplify further the fitting of the ejector pump according to the invention if an annular sealing surface is arranged on the outer side of the mixing tube to seal off the ejector pump fitted in the delivery unit or in the surge chamber.

The ejector pump according to the invention can be easily braced in an adjacent component if snap-in means are arranged on the outer side of the mixing tube for fastening on the delivery unit or on the surge chamber.

According to another advantageous development of the invention, the snap-in means are of a particularly simple design if they take the form of snap-in hooks.

The production of the ejector pump according to the invention can be performed in a mold which allows for the most part axial demolding if the entire mixing tube is made straight or conically widening from the intake region to its free end. It goes without saying that straight sections of the mixing tube and conical sections may alternate here.

Intake openings for taking in fuel could be arranged for example in the end face of the mixing tube receiving the nozzle. The ejector pump according to the invention is of a particularly compact form, however, if the holding elements for lateral delimitation are formed by intake openings arranged in the lateral surface of the mixing tube.

The invention allows numerous embodiments. To illustrate its basic principle further, one of these is represented in the drawing and is described below. In the drawing,

DESCRIPTION OF THE PRESENTLY PREFERRED EMBODIMENTS

Figure 1:
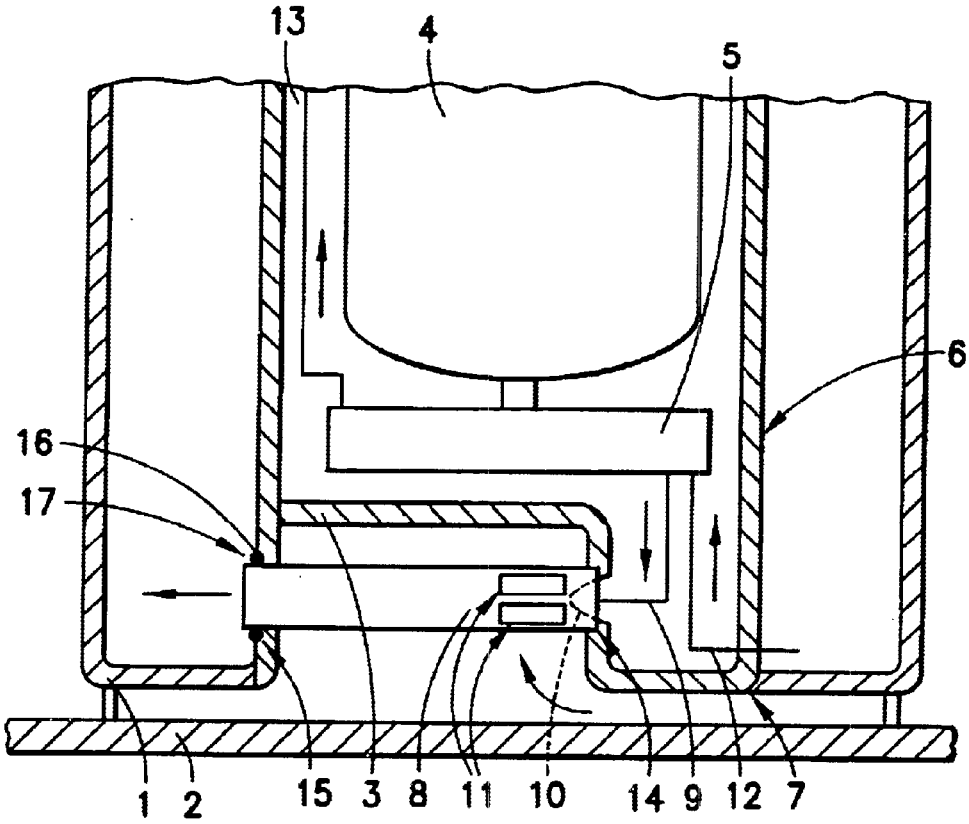
FIG. 1 is a schematic representation of a delivery unit with an ejector pump according to an embodiment of the present invention.

FIG. 1 schematically shows a delivery unit 3 fitted in a surge chamber 1 of a fuel tank 2 of a motor vehicle. The delivery unit 3 has an impeller 5, driven by an electric motor 4, of a delivery pump 6 and has been inserted in a sealing manner into an opening 7 in the base of the surge chamber 1. Arranged in the holder for the delivery unit 3 is an ejector pump 8. The ejector pump 8 is supplied with fuel via a fuel line 9 connected to the impeller 5. The fuel delivered to the ejector pump via the fuel line initially passes to a nozzle 10. The ejector pump 8 takes in fuel from the fuel tank 1 via intake openings 11 and delivers it into the surge chamber 1. The delivery pump 6 takes in fuel from the surge chamber 1 via a line 12 and delivers it via a further line 13 to an internal combustion engine (not represented) of the motor vehicle. To illustrate this, the flows of the fuel are indicated in the drawing by arrows. The ejector pump 8 has on its end face close to the nozzle 10 a sealing flange 14, with which it is braced against a correspondingly shaped region of the delivery unit 3. With its end lying opposite the sealing flange 14, the ejector pump 8 penetrates a clearance 15 of the delivery unit 3. Arranged in the clearance 15 is an O-ring 16. The ejector pump 8 has an annular sealing surface 17 in this region.

Figure 2:
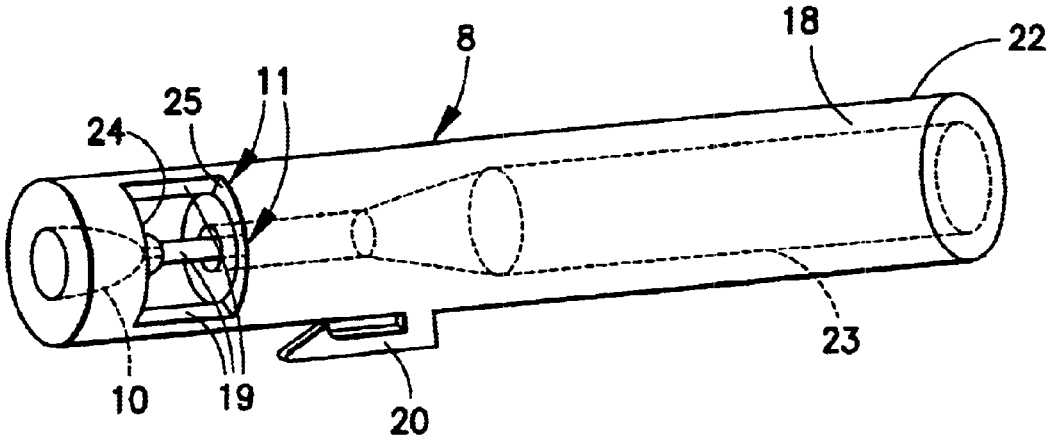
FIG. 2 is a perspective view of the ejector pump from FIG. 1.

FIG. 2 shows the ejector pump 8 from FIG. 1 in a perspective representation. The ejector pump has a mixing tube 18 opposite the nozzle 10. The intake openings 11 are arranged in the mixing tube 18 in the region of the latter adjacent to the nozzle 10. The intake openings 11 are laterally delimited by holding elements 19 formed as webs connected to opposing end faces 24, 25 of the nozzle 10 and the mixing tube 18 respectively. Furthermore, the mixing tube 18 has a snap-in hook 20 fastened on the outer lateral surface. The radially outer and inner surfaces 22, 23 of the mixing tube 18 are in each case cylindrically shaped. The nozzle 10 tapers toward the mixing tube 18. This allows the ejector pump 8, with the exception of the intake openings 11, to be produced integrally in a mold allowing axial demolding. The intake openings 11 can be produced for example by means of cores to be placed into the mold or by machining.

What is claimed is:

1. An ejector pump, comprising:

a nozzle arranged for receiving a supply of fuel;

a mixing tube arranged downstream of said nozzle having a first end adjacent said nozzle and a free end opposing said first end; and holding elements arranged in a region of said first end of said mixing tube for holding said mixing tube and said nozzle in relative alignment, said holding elements comprising at least three webs interconnecting said nozzle and said mixing tube, said nozzle and said mixing tube comprising a plastic material and being produced as an interconnected component in a common mold via an injection molding process.

2. The ejector pump of claim 1, further comprising means for bracing said ejector pump in one of a delivery unit and a surge chamber of a motor vehicle fuel tank.

3. The ejector pump of claim 1, wherein a side of said nozzle facing away from said mixing tube comprises a sealing flange and means for bracing said sealing flange with a fuel line for receiving the supply of fuel.

4. The ejector pump of claim 1, further comprising an annular sealing surface arranged on an outer side of said mixing tube for sealing said ejector pump in one of a fuel delivery unit and a surge chamber of a motor vehicle fuel tank.

5. The ejector pump of claim 1, further comprising a snap-in means for fastening said ejector pump to one of a fuel delivery unit and a surge chamber of a motor vehicle fuel tank.

6. The ejector pump of claim 5, wherein said snap-in means comprises a snap-in hook.

7. The ejector pump of claim 1, wherein said nozzle and said mixing tube comprise mutually opposing end faces and said at least three webs are connected to said mutually opposing end faces for interconnecting said nozzle and said mixing tube.

8. An ejector pump of comprising:

a nozzle arranged for receiving a supply of fuel;

a mixing tube arranged downstream of said nozzle having a first end adjacent said nozzle and a free end opposing said first end; and holding elements arranged in a region of said first end of said mixing tube for holding said mixing tube and said nozzle in relative alignment, said nozzle and said mixing tube comprising a plastic material and being produced as an interconnected component in a common mold via an injection molding process, wherein said mixing tube comprises a radially inner surface and a radially outer surface, wherein said radially inner surface comprises at least one portion, said at least one portion comprising a shape of one of a straight tube and a conically widening tube from said first end to said free end.

9. An ejector pump of comprising:

a nozzle arranged for receiving a supply of fuel:

a mixing tube arranged downstream of said nozzle having a first end adjacent said nozzle and a free end opposing said first end; and holding elements arranged in a region of said first end of said mixing tube for holding said mixing tube and said nozzle in relative alignment, said nozzle and said mixing tube comprising a plastic material and being produced as an interconnected component in a common mold via an injection molding process, wherein said mixing tube comprises a radially inner surface and a radially outer surface, said holding elements being formed between intake openings arranged in said radially outer surface of said mixing tube adjacent said first end of said mixing tube.

* * * * *